US009651888B2

(12) United States Patent
Muranaka et al.

(10) Patent No.: US 9,651,888 B2
(45) Date of Patent: May 16, 2017

(54) ELECTROCONDUCTIVE MEMBER WITH A SURFACE LAYER INCLUDING A POROUS BODY HAVING A CONTINUOUS OPEN PORE

(71) Applicant: CANON KABUSHIKI KAISHA, Tokyo (JP)

(72) Inventors: Norifumi Muranaka, Yokohama (JP); Kazuhiro Yamauchi, Suntou-gun (JP); Yuichi Kikuchi, Susono (JP); Koji Otsuka, Yokohama (JP); Masaki Imoto, Tokyo (JP); Tetsuo Hino, Yamato (JP); Satoru Nishioka, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/491,420

(22) Filed: Sep. 19, 2014

(65) Prior Publication Data

US 2015/0093151 A1 Apr. 2, 2015

(30) Foreign Application Priority Data

Sep. 27, 2013 (JP) ..... 2013-202665

(51) Int. Cl.
*G03G 15/02* (2006.01)
*G03G 15/16* (2006.01)

(52) U.S. Cl.
CPC ..... *G03G 15/0291* (2013.01); *G03G 15/0233* (2013.01); *G03G 15/1685* (2013.01)

(58) Field of Classification Search
CPC ..... G03G 15/0291; G03G 15/0233; G03G 15/1685
(Continued)

(56) References Cited

U.S. PATENT DOCUMENTS 6,904,253 B2 6/2005 Hosokawa et al.
8,715,830 B2 5/2014 Yamada et al.
(Continued)

FOREIGN PATENT DOCUMENTS

EP 1 251 409 A2 10/2002
JP 4-51168 A 2/1992
(Continued)

OTHER PUBLICATIONS

European Search Report dated Feb. 5, 2015 in European Application No. 14186517.0.

*Primary Examiner* — David Gray
*Assistant Examiner* — Andrew V Do
(74) *Attorney, Agent, or Firm* — Fitzpatrick Cella Harper and Scinto

(57) ABSTRACT

The electroconductive member has an electroconductive support and a surface layer formed on the electroconductive support, wherein the surface layer has a porous body having a continuous open pore, and the electroconductive member satisfies the following (1) and (2):
(1) in a specific condition, a surface potential of the electroconductive member, after an elapse of 10 seconds since a completion of a discharge is 10 V or more; and
(2) when applying a direct voltage between a polyethylene terephthalate film as a member to be charged and the electroconductive member, and charging the polyethylene terephthalate film, $|Vd| \geq |Vin| - |Vth|$ is satisfied within a range of $|Vin| > |Vth|$, wherein, Vd represents a charge potential of the polyethylene terephthalate film, Vin represents a voltage applied between the electroconductive member and the polyethylene terephthalate film, Vth represents a discharge starting voltage.

10 Claims, 6 Drawing Sheets

(58) Field of Classification Search
USPC ..... 399/176, 115
See application file for complete search history.

(56) References Cited

U.S. PATENT DOCUMENTS

| | | | | |
|---|---|---|---|---|
| 2002/0015601 | A1 | 2/2002 | Ishiyama | |
| 2002/0197082 | A1* | 12/2002 | Hosokawa et al. | 399/176 |
| 2005/0152718 | A1* | 7/2005 | Osada et al. | 399/267 |
| 2012/0224897 | A1* | 9/2012 | Qi | B82Y 30/00 399/333 |
| 2013/0251432 | A1* | 9/2013 | Vella et al. | 399/346 |
| 2014/0221184 | A1 | 8/2014 | Arimura et al. | |
| 2014/0234764 | A1 | 8/2014 | Aoyama et al. | |
| 2014/0287899 | A1 | 9/2014 | Nishioka et al. | |

FOREIGN PATENT DOCUMENTS

| | | | |
|---|---|---|---|
| JP | 7-104555 | A | 4/1995 |
| JP | 2000-206779 | A | 7/2000 |
| JP | 2001-99137 | A | 4/2001 |
| JP | 2002-318484 | | 10/2002 |
| JP | 2004-245933 | A | 9/2004 |
| JP | 2005-316263 | A | 11/2005 |
| JP | 2008-233157 | A | 10/2008 |
| JP | 2011-64783 | A | 3/2011 |

* cited by examiner

ELECTROCONDUCTIVE MEMBER WITH A SURFACE LAYER INCLUDING A POROUS BODY HAVING A CONTINUOUS OPEN PORE

BACKGROUND OF THE INVENTION

Field of the Invention

The present invention relates to an electroconductive member that charges a member to be charged by discharge, in particular, an electroconductive member that can be utilized as a charging member, a transfer member or the like for use in an electrophotographic apparatus, as well as a process cartridge and an electrophotographic apparatus using the same.

Description of the Related Art

An electroconductive member that charges a member to be charged by discharge is used for an electrophotographic apparatus, an ozone generation apparatus, a neutralization apparatus, an air cleaner, an electrostatic dust collector, an electrostatic coating apparatus, an electrostatic adsorption apparatus or the like. In particular, in the electrophotographic apparatus, for example, an electroconductive member such as a charging member or a transfer member is used.

In the electrophotographic apparatus, the electroconductive member is disposed in contact with or close to a recording medium including an electrophotographic photosensitive member or a dielectric member that serves as the member to be charged, and the surface of such a member to be charged is subjected to a charging treatment by discharge due to application of a direct voltage obtained by superimposing an alternate voltage or only a direct voltage.

With an increase in speed of an electrophotographic image forming process, a time spent for charging the member to be charged has been relatively shorter in recent years. Such a trend is disadvantageous for stably and certainly charging the member to be charged. Specifically, the increase in speed of an electrophotographic image forming process makes it difficult to impart a sufficient charge potential to the surface of the member to be charged. In view of such a problem, Japanese Patent Application Laid-Open No. 2005-316263 discloses a technique in which the outermost layer of a charging member contains a ferroelectric particle to result in an increase in dielectric constant, thereby leading to an increase in amount of a discharge current.

In addition, Japanese Patent Application Laid-Open No. 2004-245933 discloses a technique in which at least one layer located below the surface layer of a multi-layer charging member is a layer high in electric resistance to thereby result in an improvement in charge performance.

According to studies by the present inventors, a voltage applied to the electroconductive member is required to be increased in order to impart a sufficient charge potential to the member to be charged in the electrophotographic image forming process having an increased speed. When the voltage applied is increased in the charging member disclosed in each of Japanese Patent Application Laid-Open No. 2005-316263 and Japanese Patent Application Laid-Open No. 2004-245933, however, a local and strong discharge (hereinafter, also referred to as "abnormal discharge") may be induced to prevent a stable discharge and to cause an image unevenness in a range from several tens of micrometers to several millimeters due to the abnormal discharge.

SUMMARY OF THE INVENTION

The present invention is directed to providing an electroconductive member having a stable charge performance so that an abnormal discharge is hardly caused even when an applying voltage is increased.

Further, the present invention is directed to providing an electrophotographic apparatus and a process cartridge that enable a high-quality electrophotographic image to be stably formed.

According to one aspect of the present invention, there is provided an electroconductive member comprising an electroconductive support, and a surface layer formed on the electroconductive support, wherein the surface layer includes a porous body having a continuous open pore, and the electroconductive member satisfies the following (1) and (2):

(1) a surface potential of the electroconductive member, after an elapse of 10 seconds since a completion of a discharge for charging of the surface of the electroconductive member, is 10 V or more, the charging of the surface of the electroconductive member is conducted with a corona discharge unit which is disposed so that a grid portion of the corona discharge unit is apart from the surface of the electroconductive member by 1 mm, by applying a voltage of 8 kV to the corona discharge unit, and discharging therefrom; and (2) when applying a direct voltage between a polyethylene terephthalate film as a member to be charged and the electroconductive member, and charging the polyethylene terephthalate film, $|Vd| \geq |Vin| - |Vth|$ is satisfied within a range of $|Vin| > |Vth|$, wherein, Vd represents a charge potential of the polyethylene terephthalate film, Vin represents a voltage applied between the electroconductive member and the polyethylene terephthalate film, Vth represents a discharge starting voltage.

According to another aspect of the present invention, there is provided a process cartridge constituted to be attachable to and detachable from a main body of an electrophotographic apparatus, comprising the electroconductive member and an electrophotographic photosensitive member. According to further aspect of the present invention, there is provided an electrophotographic apparatus comprising the electroconductive member and an electrophotographic photosensitive member.

Further features of the present invention will become apparent from the following description of exemplary embodiments with reference to the attached drawings.

DESCRIPTION OF THE EMBODIMENTS

Figure 1:
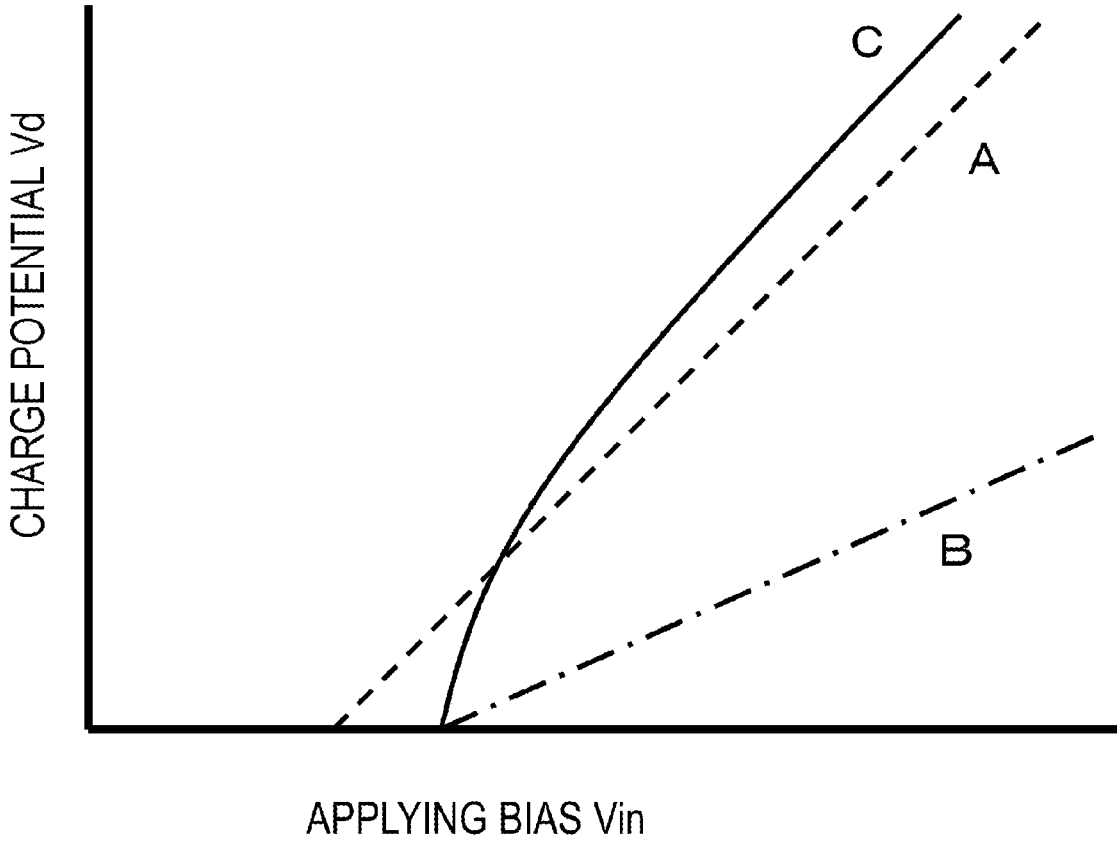
FIG. 1 is a graph illustrating one example of discharge characteristics of an electroconductive member.

Preferred embodiments of the present invention will now be described in detail in accordance with the accompanying drawings.

A proximity discharge phenomenon in the atmosphere is generated according to the Paschen's law. The phenomenon is specifically a diffusion phenomenon of an electron avalanche in which a liberated electron is exponentially increased while being accelerated by an electric field and colliding with a gas molecule and an electrode in the air to generate an electron and a positive ion in a repeated manner. The electron avalanche is diffused according to an electric field, and the diffusion determines a final amount of discharge charge. The amount of discharge charge here is exponentially increased as the electric field in a discharge space is stronger. Therefore, when an excessive electric field relative to the condition according to the Paschen's law is achieved, a local and strong discharge (abnormal discharge) is easily generated. In particular, when a discharge gap typically observed in a contact charge roller for use in an electrophotographic apparatus is narrower along with a process, an excessive electric field is generated and a local and strong discharge is generated if no discharge in a relatively wide gap is stably generated. In an excessive electric field, an increase in charge bias leads to a large change in electric field, easily resulting in a stronger discharge.

It is effective for suppressing the abnormal discharge to decrease the electric field in a discharge space. When the electric field in a discharge space is merely decreased, however, the amount of discharge charge may be reduced to cause charge failure of a member to be charged. In this regard, according to the Townsend theory, the amount of discharge charge is determined by the number of initial electrons and the electric field in a discharge space. That is, the number of initial electrons is required to be increased in order to not only decrease the electric field in a discharge space but also ensure a required amount of discharge charge.

The present inventors have made intensive studies, and as a result, have found that the problem can be solved by an electroconductive member including an electroconductive support, and a surface layer formed on the electroconductive support, wherein the surface layer includes a porous body having a continuous open pore, and the electroconductive member satisfies the following (1) and (2).

(1) A surface potential of the electroconductive member, after an elapse of 10 seconds since a completion of a discharge for charging of the surface of the electroconductive member, is 10 V or more, the charging of the surface of the electroconductive member is conducted with a corona discharge unit which is disposed so that a grid portion of the corona discharge unit is apart from the surface of the electroconductive member by 1 mm, by applying a voltage of 8 kV to the corona discharge unit, and discharging therefrom.

(2) When applying a direct voltage between a polyethylene terephthalate film as a member to be charged and the electroconductive member, and charging the polyethylene terephthalate film, $|Vd| \geq |Vin| - |Vth|$ is satisfied within a range of $|Vin| > |Vth|$, wherein, Vd represents a charge potential of the polyethylene terephthalate film, Vin represents a voltage applied between the electroconductive member and the polyethylene terephthalate film, Vth represents a discharge starting voltage.

The reason why the electroconductive member according to the present invention can solve the above problem is considered as follows.

When the surface layer of the electroconductive member includes a porous body having a continuous open pore, the discharge generated between the surface layer and the member to be charged is continuously generated also in the surface layer. Here, the discharge generated between the surface layer and the member to be charged allows the surface layer to be charged by a positive ion or an electron. The charge polarity of the surface layer is a polarity opposite to an applying bias between the electroconductive member and the polyethylene terephthalate film, and thus the electric field in the surface layer is increased and the electric field between the surface layer and the member to be charged is decreased.

Then, as long as the surface layer has a potential of 10 V or more on the surface after the elapse of 10 seconds since the completion of the discharge as defined in (1) above, the electric field between the surface layer of a charging member and the member to be charged in a step of charging the member to be charged such as an electrophotographic photosensitive member by the charging member can be significantly weakened.

With respect to (1) above, when the surface potential, after the elapse of 10 seconds since the completion of the discharge, is less than 10 V, the effect of weakening the electric field between the surface layer of the electroconductive member and the member to be charged is not sufficiently achieved. As a result, the effect of suppressing the abnormal discharge may not be sufficiently achieved.

In a local strong discharge, here, the electric field between the surface layer and the member to be charged is dominant, as described above. Accordingly, when the electric field between the surface layer and the member to be charged is decreased, a local and strong discharge is suppressed (decrease in electric field in a discharge space). When the electric field between the surface layer and the member to be charged is merely decreased, however, the charge potential of the member to be charged is decreased as described above.

FIG. 1 illustrates a relationship between the applying bias Vin and the charge potential Vd of the member to be charged. In an electroconductive member in which the surface layer has no open pore, or an electroconductive member in which, while the surface layer has an open pore, no discharge is generated in the surface layer, a relationship of $|Vd| = |Vin| - |Vth|$ is satisfied within a range of $|Vin| > |Vth|$ in which discharge is generated, wherein Vin represents the voltage applied between the electroconductive member and the polyethylene terephthalate film and Vth represents the discharge starting voltage (dotted line "A" in FIG. 1).

When (1) above is satisfied, however, the amount of charge is increased and also the decrease in electric field in a discharge region is promoted along with the progress of discharge, and thus $|Vd| < |Vin| - |Vth|$ is satisfied (dashed line "B" in FIG. 1).

On the other hand, when the surface layer has a dischargeable continuous open pore, the surface layer is charged to thereby result in the increase in electric field in the surface layer, subsequently generating the discharge in the surface layer. The electron generated in the surface layer promotes the discharge between the surface layer and the member to be charged, resulting in the increase in amount of discharge charge to the member to be charged (increase in the number of initial electrons, line "C" in FIG. 1).

Therefore, the electroconductive member simultaneously satisfying (1) and (2) above, even if the applying voltage is increased, can suppress the abnormal discharge, and an electroconductive member having high chargeability can be obtained.

Hereinafter, the electroconductive member of the present invention is described in detail. Hereinafter, a charging member is described as a representative example of the electroconductive member, but the electroconductive member of the present invention is not limited to such a charging member in terms of the shape and application thereof.

Figure 2A:
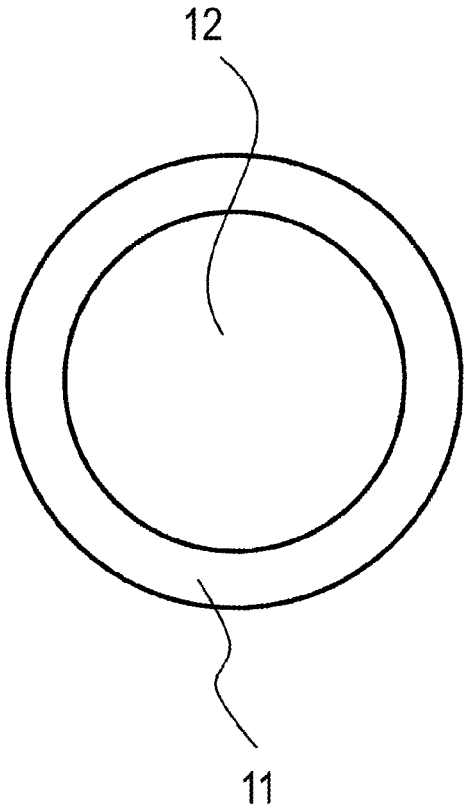
FIG. 2A is a view illustrating a cross section perpendicular to the shaft direction of a charge roller as one example of the electroconductive member.
Figure 2B:
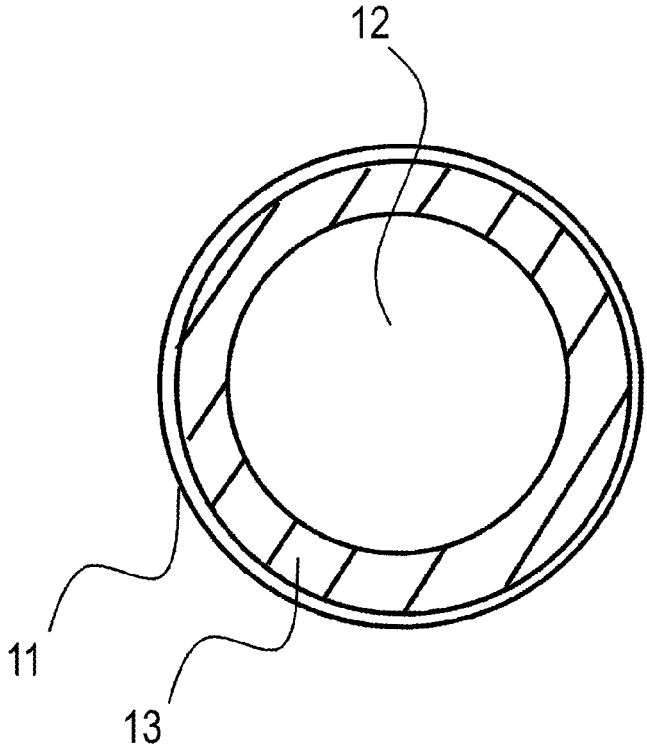
FIG. 2B is a view illustrating a cross section perpendicular to the shaft direction of a charge roller as one example of the electroconductive member.

FIG. 2A and FIG. 2B are schematic views of the electroconductive member of the present invention. The electroconductive member includes a surface layer including a porous body on the circumferential face of an electroconductive support, and can be used as an electrophotographic charging member. The electroconductive member can include a mandrel 12 as the electroconductive support, and a surface layer 11 including a porous body having a continuous open pore, provided on the circumference of the mandrel, for example, as illustrated in FIG. 2A. Furthermore, the electroconductive member may include a mandrel 12, an electroconductive resin layer 13 provided on the circumference of the mandrel, and also a surface layer 11 including a porous body having a continuous open pore, provided on the circumference of the electroconductive resin layer, as illustrated in FIG. 2B. Thus, the electroconductive support may have an electroconductive resin layer on the circumference of a mandrel. The electroconductive resin layer 13 can have a multi-layer configuration in which a plurality of electroconductive resin layers having a different material are disposed, as long as the effect of the present invention can be achieved.

<Electroconductive Support>

(Mandrel)

As the mandrel, a member appropriately selected from members that can be utilized for the electroconductive member, depending on the application, can be used. As the mandrel for an electrophotographic charging member, for example, a cylindrical material can be utilized in which the surface of a carbon steel alloy is nickel-plated at a thickness of about 5 μm.

(Electroconductive Resin Layer)

As a material for forming the electroconductive resin layer, a rubber material, a resin material or the like can be used. The rubber material is not particularly limited, and can be appropriately selected and used depending on the application of the electroconductive member. Examples of the rubber material for the electrophotographic charging member include an epichlorohydrin homopolymer, an epichlorohydrin-ethylene oxide copolymer, an epichlorohydrin-ethylene oxide-allyl glycidyl ether terpolymer, an acrylonitrile-butadiene copolymer, a hydrogenated product of an acrylonitrile-butadiene copolymer, a silicone rubber, an acrylic rubber and a urethane rubber. Examples of the resin material for the electrophotographic charging member include an acrylic resin, polyurethane, polyamide, polyester, polyolefin, an epoxy resin and a silicone resin. The materials can also be used in combination of two or more, if necessary.

The following can be, if necessary, added to the electroconductive resin layer in order to adjust the electric resistance value.

Carbon black and graphite exhibiting electronic conductivity; oxides such as tin oxide; metals such as copper and silver; an electroconductive particle whose electroconductivity is imparted by covering the surface of the particle with an oxide or metal; a quaternary ammonium salt exhibiting ion conductivity; an ion conductive agent having an ion-exchange performance, such as sulfonate; and the like.

A filler, a softener, a processing aid, a tackifier, an anti-tackifier, a dispersant, a foaming agent, a coarsening particle or the like generally used as a blending agent of a resin can be added as long as the effect of the present invention is not impaired.

The electric resistance value of the electroconductive resin layer can be set so that a volume resistivity selected within a range of $1\times10^{2}$ Ω·cm or more and $1\times10^{10}$ Ω·cm or less is achieved.

<Porous Body for Forming Surface Layer>

It is important for the porous body for forming the surface layer according to the present invention to have the following configuration, from the viewpoint of suppressing the abnormal discharge.

[Structure of Porous Body]

The porous body for forming the surface layer has a structure having a continuous open pore. The structure means that a pore is continuously connected to each other in the surface layer and a void in the pore is also connected to the outside of the surface layer. The porous body, in order to promote a continuous discharge, preferably has a configuration in which a plurality of pores is continuously connected and each of the pores is communicated with the outside of the surface layer at least in the thickness direction of the surface layer. In order to promote a continuous discharge, further preferably, the porous body may have a configuration in which some of the plurality of pores may intersect to be communicated in the direction intersecting the thickness of the surface layer. Further preferably, the surface layer may have a configuration in which a plurality of pores is linked so that the outside of the surface layer, facing the electroconductive support, is communicated with the outside of the surface layer, facing the surface. Such a continuous open pore enables an electron generated by the discharge in the surface layer to be transferred to the outside of the surface layer.

[Form of Porous Body]

In order to satisfy (1) above, the electroconductive member is required to have an electric characteristic so that the member can be charged by corona discharge. In addition, in order to satisfy (2) above, a sufficient discharge in the surface layer is required to be generated. In order to achieve (1) and (2) above, it is important to control the thickness, porosity, surface area and volume resistivity of the surface layer.

1. Volume Resistivity

In order that the electroconductive member satisfies (1) above, charge decay from the surface layer charged by corona discharge to the electroconductive support or the electroconductive resin layer is required to be suppressed. Therefore, the surface layer can be non-electroconductive. In order that the surface layer is non-electroconductive, the surface layer can be prepared while the volume resistivity is set to at least $1.0\times10^{10}$ Ω·cm.

2. Porosity

In order to generate a sufficient discharge in the surface layer, air necessary for the discharge is required to be present in the surface layer. As the porosity is higher, the discharge in the surface layer is more easily generated. The reason for this is considered because a certain amount or more of air is required for generating the discharge in the surface layer. In order to satisfy (1) and (2) above in the surface layer, namely, effectively achieve both of objective charge and discharge, the porosity of the surface layer can be selected within a range from 40% to 98%.

3. Specific Surface Area

The specific surface area in the present invention means a surface area per unit area, and represents the entire surface area of the porous body present in the unit area observed from the member to be charged, namely, the entire surface area of the porous body present in the unit area on the outer surface of the surface layer (including the surface area in the continuous open pore). In order to satisfy (1) and (2) above in the surface layer, namely, more effectively achieve both of objective charge and discharge, the specific surface area of the porous body for forming the surface layer can be selected within a range from 0.5 $\mu m^2/\mu m^2$ to 100 $\mu m^2/\mu^2$.

4. Thickness

As the thickness of the surface layer is larger, the amount of charge to the surface layer is increased. In addition, taking the reduction in voltage shared between the surface layer and the member to be charged due to the increase in voltage shared by the surface layer into consideration, the thickness of the surface layer can be suppressed up to a certain value. From such reasons, the thickness of the surface layer can be within a range from 1 μm to 200 μm.

[Method for Producing Porous Body]

A method for producing the porous body for forming the surface layer is not particularly limited as long as the porous body can be formed as the surface layer on the electroconductive support, and includes the following production methods.

Method for depositing a fine fiber prepared by melt spinning or electric spinning.

Method for forming a pore by utilizing phase separation of a polymer solution.

Method for forming a pore by utilizing a foam.

Method for forming a pore by irradiation with an energy beam such as laser.

Method for depositing a resin particle.

In the above methods, the porous body according to the present invention can have a pore and a skeleton formed in the order of submicron to several tens of microns, and can be effectively formed in a complicated shape. Therefore, the method for depositing a fine fiber prepared by electric spinning, the method utilizing layer separation of a polymer solution, or the like can be adopted.

Examples of a method for preparing a fine fiber having an average fiber diameter of about 0.01 to 40 μm include an electrospinning method (electric spinning method•electrostatic spinning method), a composite spinning method, a polymer blend spinning method, a melt-blow spinning method and a flash spinning method. Among the methods for preparing a fine fiber, the electrospinning method can be adopted in order to form a pore and a skeleton in the order of submicron to several tens of microns.

Figure 3:
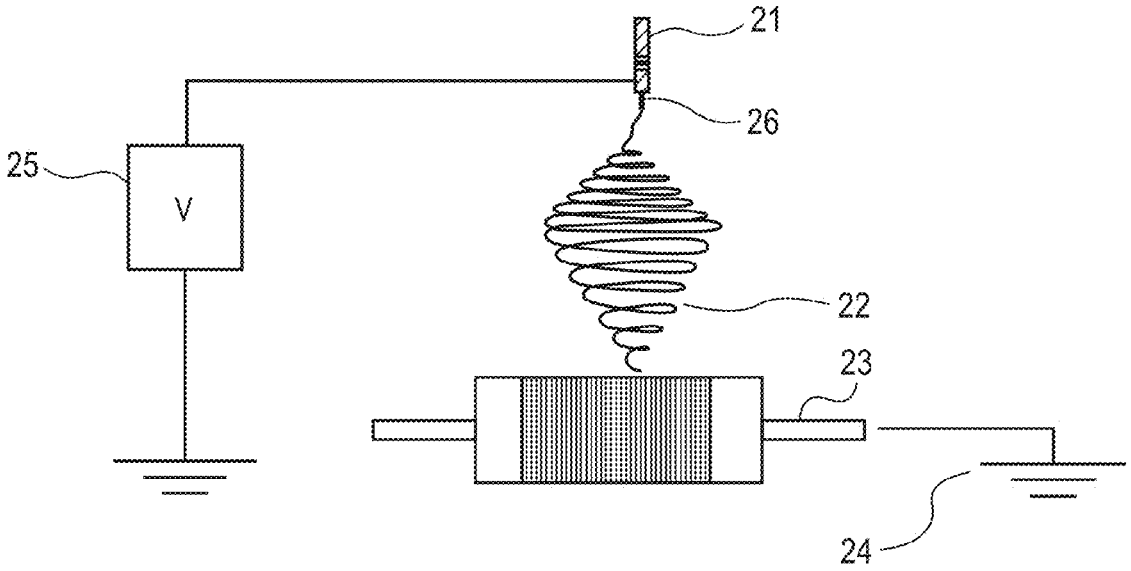
FIG. 3 is a view for describing an electrospinning method as one example of a method for producing a surface layer.

A method for preparing a fiber layer (surface layer) by the electrospinning method is described with reference to FIG. 3. As illustrated in FIG. 3, a high-voltage power supply 25, a storage tank 21 of a liquid raw material for forming a porous body, a nozzle 26 and an electroconductive support 23 grounded 24 are used.

Figure 4:
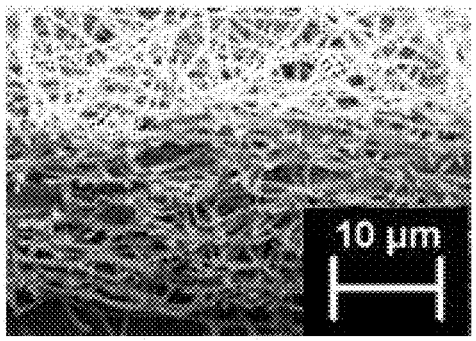
FIG. 4 is an image of a cross section of a surface layer prepared by the electrospinning method.

The liquid raw material is extruded from the storage tank 21 to the nozzle 26 at a certain speed. A voltage of 1 to 50 kV is applied to the nozzle 26, and when an electric attractive force exceeds the surface tension of the liquid raw material, a jet 22 of the liquid raw material is ejected towards the electroconductive support 23. When the liquid raw material is here a liquid raw material in which a solvent is used, the solvent in the jet 22 is gradually volatilized, and the liquid raw material is formed into a fiber before reaching the electroconductive support 23, has a reduced diameter of several tens of micrometers or lower, and is solidified with attaching along with the surface shape of the electroconductive support 23. A method may be adopted in which a liquid material molten by heating to a temperature equal to or higher than the melting point with no solvent is utilized as the liquid raw material to form a fiber by the reduction in temperature in the jet 22. As one example, an image of the cross section of a surface layer prepared by the electrospinning method is illustrated in FIG. 4.

Then, the method for forming a surface layer by utilizing phase separation of a polymeric material solution is described. The polymeric material solution here represents a solution including a polymeric material and a solvent. Examples of the method utilizing phase separation of a polymeric material solution include the following three methods. A surface layer formed by such a method is a surface layer having a so-called co-continuous structure having a three-dimensionally continuous skeleton having a polymeric material and a three-dimensionally continuous open pore.

1. A plurality of polymeric materials or precursors of the polymeric materials, and a solvent are mixed, and the temperature, the humidity, the solvent concentration, the compatibility between the plurality of polymeric materials in polymerization of the polymeric materials, and the like are changed to thereby induce phase separation between the polymeric material and the polymeric material. Thereafter, one of the polymeric materials is removed to thereby provide a porous body in which a continuous skeleton and a continuous pore coexist. As one example, a combination of polymeric materials that are compatible with each other in a solution and are not compatible with each other after drying is selected. After the polymer solution is applied to the electroconductive resin layer according to the present invention, phase separation between the polymeric materials progresses in the course of drying to form a phase separation structure. After drying, the resultant is immersed in a selected solvent that can dissolve only one of the polymeric materials. The immersing step can allow one of the polymeric materials to be eluted, providing a porous structure.

2. A polymeric material or a precursor of the polymeric material, and a solvent are mixed, and the temperature, the humidity, the solvent concentration, the compatibility between the polymeric material and the solvent in polymerization of the polymeric material, and the like are changed to thereby induce phase separation between the polymeric material and the solvent (spinodal decomposition). Thereafter, the solvent is removed to thereby provide a porous body in which a continuous skeleton and a continuous pore coexist.

Specifically, a polymeric material and a solvent that are not compatible with each other at ordinary temperature and are compatible with each other in heating are first selected. Examples of such a combination of a polymeric material and a solvent include a combination of polylactic acid (polymeric material) and dioxane (solvent), and a combination of poly(methyl methacrylate) (PMMA) (polymeric material) and ethanol (solvent). Then, the electroconductive support according to the present invention is immersed in a coating liquid, in which the polymeric material is dissolved in the solvent, with heating under reflux. Thereafter, the resultant is left to still stand at ordinary temperature to thereby allow phase separation of the polymeric material and the solvent to progress, forming a layer of the polymeric material, including a solvent phase therein, around the electroconductive support. Finally, the solvent is removed from the layer of the polymeric material to thereby provide a porous structure having the polymeric material.

3. A polymeric material, water, a solvent, a surfactant and a polymerization initiator are mixed to prepare a water-in-oil emulsion, the polymeric material is polymerized in the oil, and thereafter water is removed to thereby provide a porous body in which a continuous skeleton and a continuous pore coexist. As one example, a precursor of the polymeric material is dissolved in a non-aqueous solvent, and the resultant is mixed with water and the surfactant to adjust an emulsion solution. Then, the electroconductive resin layer according to the present invention is immersed in the solution. After the immersion, the polymeric material in the emulsion solution is polymerized. After the polymerization, water can be evaporated in the course of drying to provide a porous structure.

Figure 5:
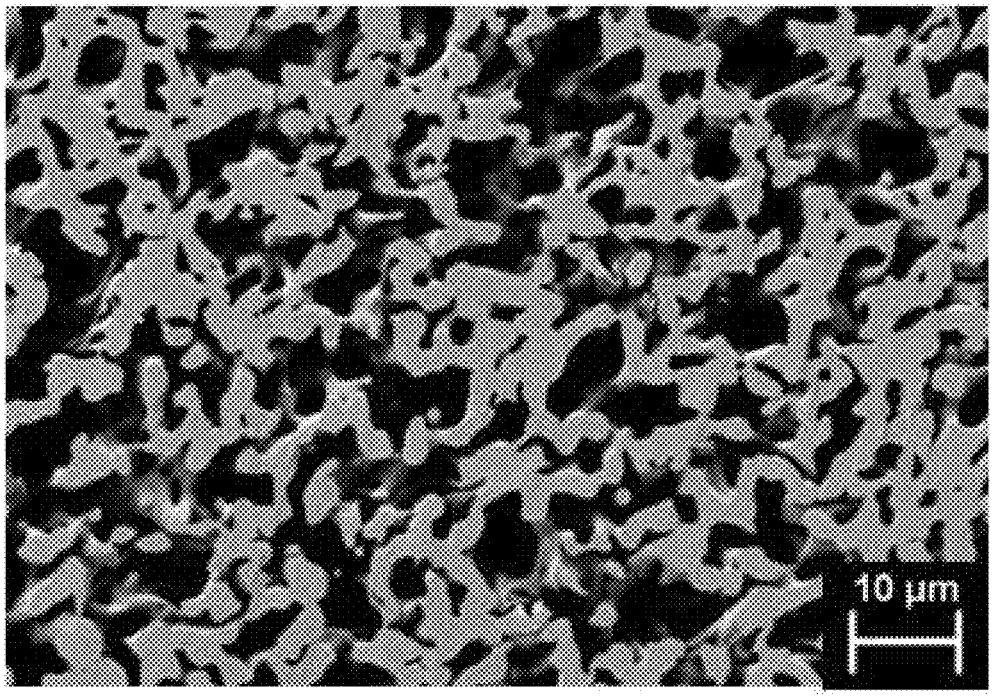
FIG. 5 is an image of a cross section of a surface layer prepared by a method utilizing spinodal decomposition.

Among the methods, in the method described in 2, the structure is easily secured at the initial stage of phase separation, and thus the pore and skeleton of the porous body can be effectively finely formed. Furthermore, the method can be adopted because a porous body having a complicated shape characteristic in spinodal decomposition is easily formed. Herein, FIG. 5 illustrates one example of an image of the cross section of a surface layer prepared by the method 2.

[Material for Forming Porous Body Layer]

The material of the skeleton for forming the porous body according to the present invention, namely, the material for forming a skeleton or wall that defines each pore is not particularly limited as long as the material can form the porous body. As the material for forming the porous body, an organic material including a resin material, an inorganic material such as silica or titania, or a hybrid material of the organic material and the inorganic material can be used.

Examples of the resin material include the following: (meth)acrylic polymers such as poly(methyl methacrylate), and polyolefin type polymers such as polyethylene and polypropylene; polystyrene; polyimide, polyamide and polyamideimide; polyarylenes (aromatic polymers) such as poly(p-phenylene oxide) and poly(p-phenylene sulfide); polyether; polyvinyl ether; polyvinyl alcohol; polyolefin type polymers, polystyrene, polyimide and polyarylenes (aromatic polymer), to which a sulfonic acid group (—$SO_3H$), a carboxyl group (—COOH), a phosphorus acid group, a sulfonium group, an ammonium group or a pyridinium group is introduced; fluorine-containing polymers such as polytetrafluoroethylene and polyvinylidene fluoride; a perfluorosulfonic acid polymer, a perfluorocarboxylic acid polymer and a perfluorophosphoric acid polymer, in which a sulfonic acid group, a carboxyl group, a phosphorus acid group, a sulfonium group, an ammonium group or a pyridinium group is introduced to the skeleton of a fluorine-containing polymer; polybutadiene type compounds; polyurethane type compounds such as an elastomer and gel; epoxy type compounds; silicone type compounds; polyvinyl chloride; polyethylene terephthalate; (acetyl)cellulose; nylon; and polyarylate.

Herein, the polymers may be used singly or in combination of a plurality thereof, a polymer in which a particular functional group is introduced to the polymer chain may be used, or a copolymer produced from a combination of two or more of monomers as raw materials of the above polymers may be used.

The inorganic material includes oxides of Si, Mg, Al, Ti, Zr, V, Cr, Mn, Fe, Co, Ni, Cu, Sn and Zn. More specifically, the inorganic material includes the following metal oxides: silica, titanium oxide, aluminum oxide, alumina sol, zirconium oxide, iron oxide and chromium oxide.

[Additive]

With respect to the porous body, an additive may be added to the material for forming the porous body as long as the effect of the present invention is not impaired and the porous body can be formed. Examples of the additive include carbon black and graphite exhibiting electronic conductivity, oxides such as tin oxide, metals such as copper and silver, an electroconductive particle whose electroconductivity is imparted by covering the surface of the particle with an oxide or metal, a quaternary ammonium salt exhibiting ion conductivity, and an ion conductive agent having an ion-exchange performance, such as sulfonate. A filler, a softener, a processing aid, a tackifier, an anti-tackifier or a dispersant generally used as a blending agent of a resin may be added as long as the effect of the present invention is not impaired.

Hereinafter, the measurement methods of the respective physical properties of the electroconductive member are described. It is to be noted that physical properties in Examples and Comparative Examples described later were also measured according to the following methods.

[Measurement of Thickness]

The thickness of the surface layer is the thickness of the surface layer measured in the direction perpendicular to the surface of the electroconductive support, and means the average value of thicknesses at 25 points in total, obtained by dividing the longitudinal direction of the charging member to five equal parts and measuring the thicknesses of sections cut out at any 5 points in each of the parts. In addition, the thickness of the surface layer at each point can also be measured by cutting out a section including the electroconductive support and the surface layer from the charging member and subjecting the section to X-ray CT measurement or the like.

[Measurement of Specific Surface Area]

The specific surface area of the surface layer can be measured by the BET method, and for example, can be determined by measuring the BET of a material forming a surface layer having a known surface area, subsequently measuring the BET of the surface layer, and calculating the ratio of the BETs. The specific surface area of the surface layer of the present invention means the average value of specific surface areas at 5 points, obtained by dividing the longitudinal direction of the charging member to five equal parts and measuring the specific surface area of a section cut out at any 1 point in each of the parts.

[Measurement of Porosity]

The porosity of the surface layer is the average value of porosities measured in any two-dimensional cross section, and means the average value of porosities at 25 points in total, obtained by dividing the longitudinal direction of the charging member to five equal parts and measuring the porosities of sections cut out at any 5 points in each of the parts. In addition, the porosity at each measurement point can be observed by a SEM apparatus, and calculated by an image processing software (ImageProPlus manufactured by Media Cybernetics, Inc.). In addition, the visual field of observation may be a square, about 100 times the structural period of the pore and skeleton for forming the surface layer, on a side.

[Measurement of Surface Potential of Electroconductive Member by Corona Discharge]

Measurement of the surface potential of the electroconductive member (charging member) by corona discharge is performed using an apparatus for measuring an amount of charge (product name: DRA-2000L, manufactured by Quality Engineering Associates, Inc.). Specifically, a corona discharge unit of the apparatus for measuring an amount of charge is disposed so that the clearance between the grid portion thereof and the surface of the electroconductive member is 1 mm. Then, a voltage of 8 kV is applied to the corona discharge unit to generate discharge, charging the surface of the electroconductive member, and the surface potentials of the electroconductive member after completion of the discharge and 10 seconds after the completion are measured.

[Measurements of Charge Potential Vd and Discharge Starting Voltage Vth]

The charge potential Vd and the discharge starting voltage Vth are measured as follows.

First, the electroconductive member is disposed so as to be opposite to a surface not aluminum-deposited, of a PET (polyethylene terephthalate) sheet (product name: Metalumy S#25, produced by Toray Advanced Film Co., Ltd.) in which one surface is aluminum-deposited. The gap between the surface of the PET sheet and the surface of the electroconductive member is set to 8 μm.

A negative voltage is applied to the mandrel of the charging member, and the surface aluminum-deposited of the PET sheet is grounded. Then, the charging member and the PET sheet are relatively moved so as not to change the clearance therebetween, charging a region of 20 mm square or more. The relative movement speed herein is set to 10 mm/s. Then, potential measuring equipment (surface potential meter Model 344, manufactured by Trek Japan, probe: 6000B-7C) is disposed on the PET sheet while a clearance of 2 mm is kept, to measure the surface potential. The charge potential Vd is obtained by performing the surface potential measurement three times and calculating the average value of the three results.

In addition, the Vth is calculated from the difference between the applying bias in the change of the surface potential from 3 V to 5 V and the surface potential, and for example, when the applying bias is 500 V and the surface potential is 4 V, the Vth is 496 V.

<Process Cartridge and Electrophotographic Apparatus>

The charging member described above can be suitably used for the charging member of an electrophotographic process cartridge and an electrophotographic apparatus for use in image formation by an electrophotographic method. Hereinafter, the process cartridge and electrophotographic apparatus are described.

Process Cartridge

Figure 6:
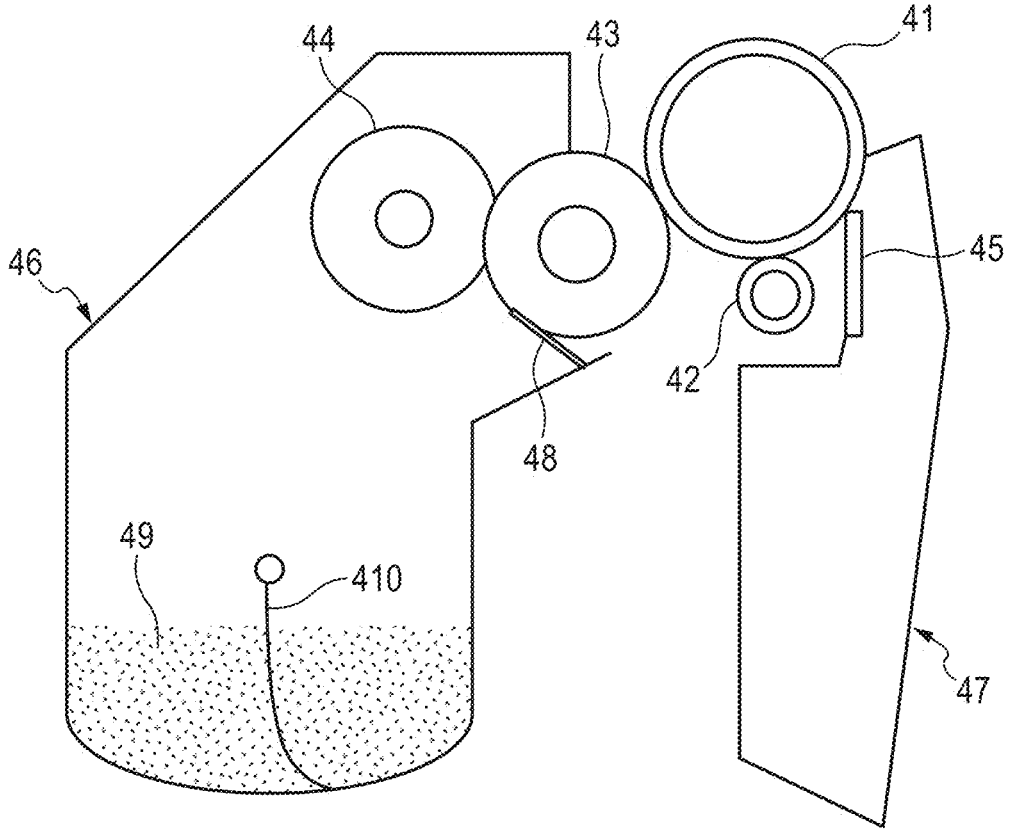
FIG. 6 is a view illustrating one example of an electrophotographic process cartridge.

FIG. 6 is a schematic cross-sectional view of an electrophotographic process cartridge equipped with the electroconductive member according to the present invention as the charging member (hereinafter, also referred to as "charge roller"). The process cartridge accommodates a charge roller 42 and a drum-shaped electrophotographic photosensitive member (hereinafter, also referred to as "photosensitive drum") 41 in an integrated manner in the container of the cartridge, and is attachable to and detachable from the main body of an electrophotographic apparatus. The process cartridge illustrated in FIG. 6 may have, in addition to the charge roller 42 and the photosensitive drum 41, a development unit configured by at least a development roller 43 and a toner container 46. Herein, the development unit may be provided with a toner supply roller 44, a toner 49, a development blade 48 and a stirring blade 410, if necessary. In addition, the process cartridge illustrated in FIG. 6 may be provided with a cleaning blade 45 and a waste toner accommodating container 47 abutting with the surface of the photosensitive drum 41.

Electrophotographic Apparatus

Figure 7:
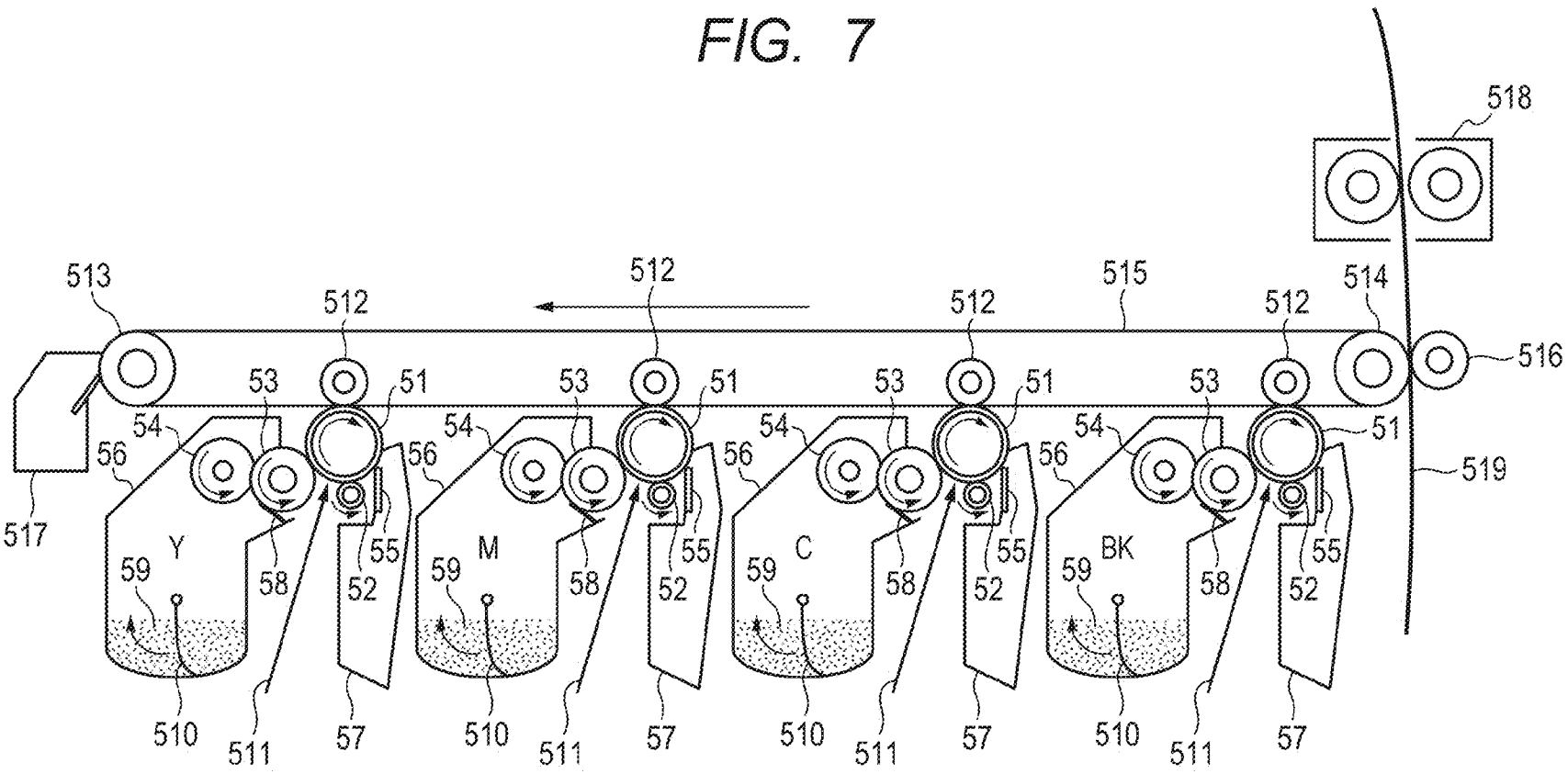
FIG. 7 is a view illustrating one example of an electrophotographic apparatus.

FIG. 7 is a schematic configuration view of an electrophotographic image forming apparatus (hereinafter, also referred to as "electrophotographic apparatus") in which the electroconductive member according to the present invention is used as the charge roller. The electrophotographic apparatus is a color image forming apparatus to which four of the process cartridges are and detachably mounted. The respective toner colors of black, magenta, yellow and cyan are used in the respective process cartridges. A photosensitive drum 51 is rotated in the arrow direction and evenly charged by a charge roller 52 to which a voltage is applied from a charge bias power supply, and an electrostatic latent image is formed on the surface of the photosensitive drum 51 by exposure light 511. On the other hand, a toner 59 stored in a toner container 56 is supplied to a toner supply roller 54 by a stirring blade 510, and conveyed onto a development roller 53. Then, the surface of the development roller 53 is uniformly coated with the toner 59 by a development blade 58 disposed in contact with the development roller 53, and a charge is provided to the toner 59 by frictional charging. The electrostatic latent image is developed by providing the toner 59 conveyed by the development roller 53 disposed in contact with the photosensitive drum 51, and visualized as a toner image.

The toner image visualized, on the photosensitive drum, is transferred by a primary transfer roller 512, to which a voltage is applied by a primary transfer bias power supply, to an intermediate transfer belt 515 supported and driven by a tension roller 513 and an intermediate transfer belt driving roller 514. The respective toner images of the respective colors are sequentially superimposed to form a color image on the intermediate transfer belt.

A transfer material 519 is fed by a feeding roller into the apparatus, and conveyed between the intermediate transfer belt 515 and a secondary transfer roller 516. The secondary transfer roller 516, to which a voltage is applied from a secondary transfer bias power supply, transfers the color image on the intermediate transfer belt 515 to the transfer material 519. The transfer material 519, to which the color image is transferred, is subjected to a fixing treatment by a fixing unit 518 and discharged out of the apparatus, and a printing operation is terminated.

On the other hand, the toner not transferred and remaining on the photosensitive drum is scraped by a cleaning blade 55 and stored in a waste toner accommodating container 57, and the step is repeatedly performed on the photosensitive drum 51 cleaned. The toner not transferred and remaining on the primary transfer belt is also scraped by a cleaning apparatus 517.

EXAMPLES

Example 1

Mandrel

As the electroconductive mandrel, a stepped round bar was provided in which the whole length was 252 mm, the outer diameter of a portion from each of both ends to a position of 11 mm in the longitudinal direction was 6 mm and the outer diameter of other central portion was 8.4 mm, and the surface of a free-cutting steel was subjected to an electroless nickel plating treatment.

[Adjustment of Liquid Raw Material 1]

The following liquid raw material 1 was prepared as a material of a surface layer for use in Example 1. First, 1 mL of a dilution was prepared in which a mixture obtained by adding poly(ethylene glycol)diglycidyl ether in a mass ratio of 8% to polycaprolactone (PCL, molecular weight: 80000, produced by Sigma-Aldrich Co., LLC.) was diluted to 10% by mass with a mixed solution of dichloromethane (DCM) and dimethylformamide (DMF) in a ratio of 75:25 (volume ratio). Then, the dilution was mixed with 10% by mass of an aromatic sulfonium salt type latent catalyst (product name: SI-60L, produced by Sanshin Chemical Industry Co., Ltd.) to the poly(ethylene glycol)diglycidyl ether, to provide liquid raw material 1.

[Measurement of Volume Resistivity]

Liquid raw material 1 was formed into a sheet-shaped film, the film was sufficiently dried, and then a sheet having a thickness of 500 μm was prepared. Thereafter, resistance measuring equipment (product name: Hiresta UP, manufactured by Mitsubishi Chemical Analytech Co., Ltd.) was used to measure the volume resistivity, which was $1\times10^{14}$ Ω·m ($1\times10^{16}$ Ω·cm) (the applying voltage was 250 V).

[Preparation of Surface Layer]

Then, liquid raw material 1 was ejected by an electrospinning method, and the resulting fiber was deposited on the side of the electroconductive mandrel. That is, the mandrel was fitted to a collector portion of an electrospinning apparatus (manufactured by Mecc Co., Ltd.), and the mandrel was grounded. Then, liquid raw material 1 was filled in a tank, liquid raw material 1 was discharged at a speed of 1.0 ml/h while a voltage of 20 kV was applied to a nozzle (non-beveled needle G22), and liquid raw material 1 was ejected towards the mandrel. Herein, the ejection was performed for 46 seconds at a movement speed of the nozzle in the longitudinal direction of the mandrel, of 10 mm/s, a rotation speed of the mandrel of 500 rpm, and a stroke of 230 mm which was the same as the length of the large diameter portion of the mandrel. Thereafter, a surface layer including the resulting porous body was placed in an oven and heat-treated at 80° C. for 3 hours to provide electroconductive member 1. With respect to electroconductive member 1 thus obtained, the measurements of the thickness, porosity and specific surface area by the above-described methods, and the following Measurements (1) and (2) and Evaluations (1) and (2) were performed. The results were listed in Table 3 together with the results in Examples 2 to 10 and Comparative Examples 1 and 2.

Herein, the diameter of the fine fiber forming the surface layer obtained by the electrospinning method was measured by the following method. That is, the fine fiber was sampled from the surface layer, and the surface thereof was subjected to platinum deposition. The resultant was embedded with an epoxy resin and cut into four equal parts having the same thickness by a microtome to make five samples. With respect to each of the samples, the cross sections of any ten fine fibers appearing on the surface cut were observed using a scanning electron microscope (SEM) (product name: S-4800, manufactured by Hitachi High-Technologies Corporation) at 2000-fold magnification, and the maximum length of each of the cross sections was measured. The maximum length was defined as the diameter of the fine fiber (fiber diameter) in each of the cross sections. As a result, the fiber diameter was in a range from 0.5 to 3.0 μm.

[Measurement (1)]

According to [Measurement of surface potential of electroconductive member by corona discharge] described above, the surface potential of electroconductive member 1 was measured 10 seconds after completion of the discharge, and the results were listed in the column of Measurement (1) in Table 3.

[Measurement (2)]

According to [Measurements of charge potential Vd and discharge starting voltage Vth] described above, the discharge starting voltage Vth was measured, thereafter the applying bias Vin was set so as to satisfy Vin=Vth−300 and Vin=Vth−600, and whether $|Vd|\geq|Vin|-|Vth|$ was satisfied or not was determined.

Then, in a case where $|Vd|\geq|Vin|-|Vth|$ was satisfied, the case was rated as "A", in a case where $|Vd|\geq|Vin|-|Vth|$ was not satisfied, the case was rated as "B", and the results were listed in the column of Measurement (2) in Table 3.

[Measurement of Volume Resistivity of Surface Layer]

The surface layer of electroconductive member 1 was cut out and sandwiched between electrodes having a diameter of 5 mm by a load of 100 g weight, and a voltage of 100 V was applied thereto. The current value flowing between the electrodes, and the thickness between the electrodes were measured to thereby determine the volume resistivity of the surface layer. As a result, the volume resistivity was $1\times10^{15}$ Ω·m or more ($1\times10^{17}$ Ω·cm or more).

[Evaluation (1)]

In order to observe the effect of suppressing a local and strong discharge of the electroconductive member of the present invention, an electrophotographic apparatus was used to perform an evaluation.

As the electrophotographic apparatus, an electrophotographic laser printer (product name: Laserjet CP4525dn, manufactured by Hewlett-Packard Development Company, L.P.) was provided. In order to put an electroconductive member in a severer evaluation environment, however, the laser printer was altered so that the output speed was 500 mm/second which was higher than the original output speed.

Then, electroconductive member 1 as a charge roller was mounted to a dedicated toner cartridge for the laser printer. The toner cartridge was mounted to the laser printer, and a halftone image (image in which lateral lines having a width of 1 dot were drawn at an interval of 2 dots in the direction perpendicular to the rotation direction of a photosensitive drum) was output under an environment of a temperature of 23° C. and a relative humidity of 50%. Herein, the image resolution was 1200 dpi, and the applying voltage between the charge roller and an electrophotographic photosensitive member was −1000 V. The resulting electrophotographic image was visually observed, and the presence of the image unevenness due to a local and strong discharge from a charging member was observed.

Then, the output of the electrophotographic image and the visual evaluation of the image were repeated in the same manner as described above except that the applying voltage was changed to −1010 V, −1020 V, −1030 V . . . every 10 V. Then, the applying voltage (VE1) at the time of forming an electrophotographic image in which the image unevenness due to a local and strong discharge from a charging member could be visually observed was recorded, and the potential (VE2) of the electrophotographic photosensitive member at the time of outputting the image at the applying voltage was measured. The values VE1 and VE2 were listed in Table 3. As a reference, the discharge starting voltage Vth of each electroconductive member was shown in Table 3.

[Evaluation (2)]

The charge potential of the photosensitive member at an applying voltage of −1100 V in the electrophotographic apparatus was measured.

Example 2

Electroconductive member 2 was prepared and evaluated in the same manner as in Example 1 except that nozzle 1 in the electrospinning method was changed to nozzle 2 (non-beveled needle G25) and liquid raw material 1 was discharged at a speed of 1.7 ml/h in Example 1.

Example 3

Electroconductive member 3 was prepared and evaluated in the same manner as in Example 1 except that the ejection by the electrospinning method was performed for 194 seconds.

Example 4

Electroconductive member 4 was prepared and evaluated in the same manner as in Example 2 except that the ejection by the electrospinning method was performed for 194 seconds.

Example 5

Electroconductive member 5 was prepared and evaluated in the same manner as in Example 1 except that the ejection by the electrospinning method was performed for 388 seconds.

Example 6

Electroconductive member 6 was prepared and evaluated in the same manner as in Example 2 except that the ejection by the electrospinning method was performed for 388 seconds.

Example 7

Mandrel

As the electroconductive mandrel, a stepped round bar was provided in which the whole length was 252 mm, the outer diameter of a portion from each of both ends to a position of 11 mm in the longitudinal direction was 6 mm and the outer diameter of other central portion was 8.4 mm, and the surface of a free-cutting steel was subjected to an electroless nickel plating treatment.

[Adjustment of Liquid Raw Material 2]

Polylactic acid (weight average molecular weight Mw: 120000, produced by Sigma-Aldrich Co., LLC.) (8.5 g), 74 g of dioxane and 11 g of distilled water were mixed, and the mixture was heated at 80° C. with stirring for 6 hours to provide liquid raw material 2.

[Measurement of Volume Resistivity]

Liquid raw material 2 was formed into a sheet-shaped film, the film was sufficiently dried, and then a sheet having a thickness of 500 μm was prepared. Thereafter, the resistance measuring equipment used in Example 1 was used to measure the volume resistivity, which was $1\times10^{13}$ Ω·m ($1\times10^{15}$ Ω·cm) (the applying voltage was 250 V).

[Preparation of Surface Layer]

Liquid raw material 2 was injected to a cylindrical container having an inner diameter of ϕ8.41 mm in which the mandrel was placed, and kept warm at 50° C. for 30 minutes and subsequently cooled at 0° C. for 1 hour, to precipitate polylactic acid on the periphery of the mandrel. Thereafter, the solvents (dioxane and distilled water) in the cylindrical container were replaced with distilled water. After 3 hours, water in the container was replaced with distilled water again. After a lapse of 3 hours, the mandrel around which a film including polylactic acid was formed was taken out from the cylindrical container, and dried in vacuum at 25° C. for 24 hours to provide electroconductive member 7 provided with a porous film including polylactic acid as a surface layer. Electroconductive member 7 obtained was evaluated in the same manner as in Example 1.

Herein, the resulting surface layer had a co-continuous structure having a three-dimensionally continuous skeleton having a polymeric material (polylactic acid) and a three-dimensionally continuous open pore, as observed from the image in the thickness measurement of the surface layer using an X-ray CT inspection apparatus (product name: TOHKEN-SkyScan 2011 (radiation source: TX-300), manufactured by Mars Tohken X-ray Inspection Co., Ltd.).

[Measurement of Volume Resistivity of Surface Layer]

The surface layer of electroconductive member 7 was cut out and sandwiched between electrodes having a diameter of 5 mm by a load of 100 g weight, and a voltage of 100 V was applied thereto. The current value flowing between the electrodes, and the thickness between the electrodes were measured to thereby determine the volume resistivity of the surface layer. As a result, the volume resistivity was $1\times10^{15}$ Ω·m or more ($1\times10^{17}$ Ω·cm or more).

Example 8

Electroconductive member 8 was prepared in the same manner as in Example 7 except that the inner diameter of the cylindrical container was changed to ϕ8.5 mm, and was evaluated in the same manner as in Example 1.

Example 9

Electroconductive member 9 was prepared and evaluated in the same manner as in Example 1 except that the ejection time by the electrospinning method was 776 seconds and furthermore the heat treatment step at 80° C. for 3 hours was performed while the surface layer abutted with a metal cylinder.

Example 10

Electroconductive member 10 was prepared and evaluated in the same manner as in Example 6 except that the heat treatment step at 80° C. for 3 hours was performed while the surface layer abutted with a metal cylinder.

Comparative Example 1

Adjustment of Unvulcanized Rubber Composition

Respective materials whose types and amounts were shown in Table 1 below were mixed by a pressure kneader to provide an A-kneaded rubber composition. Furthermore, 166 parts by mass of the A-kneaded rubber composition, and respective materials whose types and amounts were shown in Table 2 below were mixed by an open roll to prepare an unvulcanized rubber composition.

TABLE 1

| | Material | Amount blended (parts by mass) |
|---|---|---|
| Raw rubber | NBR (product name: Nipol DN219, produced by Zeon Corporation) | 100 |
| Electroconductive agent | Carbon black (product name: Tokablack #7360SB, produced by Tokai Carbon Co., Ltd.) | 40 |

TABLE 1-continued

| | Material | Amount blended (parts by mass) |
|---|---|---|
| Filler | Calcium carbonate (product name: Nanox #30, produced by Maruo Calcium Co., Ltd.) | 20 |
| Vulcanization accelerator aid | Zinc oxide | 5 |
| Processing aid | Stearic acid | 1 |

TABLE 2

| | Material | Amount blended (parts by mass) |
|---|---|---|
| Crosslinking agent | Sulfur | 1.2 |
| Vulcanization accelerator | Tetrabenzylthiuram disulfide (product name: TBZTD, produced by Sanshin Chemical Industry Co., Ltd.) | 4.5 |

<Preparation of Electroconductive Roller>

[Mandrel]

A round bar was provided in which the whole length was 252 mm and the outer diameter was 6 mm, and the surface of a free-cutting steel was subjected to an electroless nickel plating treatment. Then, a roll coater was used to apply Metaloc U-20 (product name, produced by Toyokagaku Kenkyusho Co., Ltd.) as an adhesive all-round the round bar in a range of 230 mm excluding 11 mm at both of ends of the round bar. In the present Example, the round bar to which the adhesive was applied was used as the electroconductive mandrel.

[Electroconductive Elastic Layer (Electroconductive Resin Layer)]

Then, a die having an inner diameter of 12.5 mm was attached to the tip of a crosshead extruder having a mechanism for supplying the electroconductive mandrel and a mechanism for discharging the unvulcanized rubber roller, the temperatures of the extruder and the crosshead were adjusted to 80° C. and the conveyance speed of the electroconductive mandrel was adjusted to 60 mm/second. The unvulcanized rubber composition was supplied from the extruder under the above conditions, and the circumference part of the electroconductive mandrel was covered with the unvulcanized rubber composition in the crosshead to provide an unvulcanized rubber roller. Then, the unvulcanized rubber roller was loaded in a hot air vulcanization furnace at 170° C. and heated for 60 minutes to vulcanize the rubber composition, providing a roller in which an elastic layer was formed on the circumference part of the mandrel. Thereafter, both ends of the elastic layer were cut by 10 mm for removal, and the length of the elastic layer portion in the longitudinal direction was 231 mm. Finally, the surface of the elastic layer was polished by a grindstone. Thus, electroconductive member 11 in which each diameter at each position of 90 mm from the central portion to each of both ends was 8.4 mm and the diameter of the central portion was 8.5 mm was obtained. Electroconductive member 11 obtained was evaluated in the same manner as in Example 1.

Comparative Example 2

Electroconductive member 11 obtained in Comparative Example 1 was dip-coated with a polyurethane solution to provide electroconductive member 12 provided with a polyurethane layer having a thickness of 3 μm on the circumference of electroconductive member 11. Electroconductive member 12 obtained was evaluated in the same manner as in Example 1. Herein, in Evaluation (1) in Comparative Example 2, no halftone image was output due to charge failure, and thus the evaluation could not be performed.

TABLE 3

| | Thickness (μm) | Porosity (%) | Specific surface area ($\mu m^2/\mu m^2$) | Measurement (1) (V) | Measurement (2) | Evaluation (1) VE1 (V) | Evaluation (1) VE2 (V) | Evaluation (2) Vd (V) | Reference Vth (V) |
|---|---|---|---|---|---|---|---|---|---|
| Example 1 | 8 | 95 | 2.1 | 50 | A | −1240 | −800 | −650 | −470 |
| Example 2 | 10 | 92 | 2.2 | 45 | A | −1230 | −780 | −630 | −470 |
| Example 3 | 40 | 91 | 12.4 | 240 | A | −1420 | −1000 | −680 | −500 |
| Example 4 | 48 | 90 | 14.7 | 230 | A | −1440 | −1000 | −660 | −510 |
| Example 5 | 82 | 85 | 27.2 | 420 | A | −1650 | −1000 | −430 | −600 |
| Example 6 | 95 | 82 | 29.7 | 405 | A | −1660 | −1000 | −420 | −610 |
| Example 7 | 5 | 68 | 1.3 | 25 | A | −1320 | −850 | −630 | −460 |
| Example 8 | 42 | 70 | 9.5 | 190 | A | −1370 | −920 | −640 | −500 |
| Example 9 | 56 | 55 | 54.3 | 780 | A | −1720 | −1000 | −360 | −680 |
| Example 10 | 40 | 52 | 29.7 | 408 | A | −1650 | −1000 | −430 | −630 |
| Comparative Example 1 | — | — | — | 0 | A | −1190 | −500 | −420 | −450 |
| Comparative Example 2 | 3 | — | — | 150 | B | Not evaluated | | 0 | — |

The present invention can provide an electroconductive member that can be applied to a high applying voltage, that can allow generation of a local and strong discharge to be suppressed to provide a stable discharge, and that has high chargeability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-202665, filed Sep. 27, 2013, which is hereby incorporated by reference herein in its entirety.

What is claimed is:

1. A charging member for electrophotography comprising:

an electroconductive support bearing a surface layer comprising a porous body of a polymeric material, said porous body comprising a three-dimensionally continuous skeleton and a three-dimensionally continuous open pore, wherein a porosity of the porous body is 40 to 98%, and a specific surface area of the porous body is 0.5 to 100 $\mu m^2/\mu m^2$, the surface layer has a thickness of 1 μm to 200 μm, and has a volume resistivity of the surface layer is at least $1.0\times10^{10}$ Ω·cm, and the charging member satisfies the following (1) and (2):

(1) a surface potential of the charging member is at least 10 V after an elapse of 10 seconds since a completion of a discharge for charging of the surface of the charging member, the charging of the surface of the charging member being conducted with a corona discharge unit which is disposed so that a grid portion of the corona discharge unit is apart from the surface of the charging member by 1 mm, by applying a voltage of 8 kV to the corona discharge unit and discharging therefrom, and (2) the charging member satisfies $|Vd|\geq|Vin|-|Vth|$, $|Vin|>|Vth|$ and $|Vd|\geq|Vin|-|Vth|$ when:

(a) a polyethylene terephthalate sheet having a first surface which is aluminum-deposited and a second surface which is not aluminum is disposed so that the surface of the surface layer of the charging member is opposed to the second surface of the polyethylene terephthalate sheet at a clearance of 8 μm;

(b) a negative voltage Vin is applied to the support and the first surface of the polyethylene terephthalate is grounded;

(c) the charging member and the polyethylene terephthalate sheet are moved relatively at a speed of 10 mm/s without charging the clearance therebetween, and a region of 20 mm square or more of the second surface of the polyethylene terephthalate sheet is charged;

(d) a discharge starting voltage Vth of the charging member is determined by increasing the negative voltage Vin from 0V;

(e) a surface potential Vd of the second surface of the polyethylene terephthalate sheet is the average value obtained when the applied negative voltage Vin is equal to Vth−300V three times; and (f) a surface potential Vd of the second surface of the polyethylene terephthalate sheet is the average value obtained when the applied negative voltage Vin is equal to Vth−600V three times.

2. The charging member according to claim 1, wherein the surface layer comprises a fiber formed by an electrospinning method.

3. A process cartridge constituted to be attachable to and detachable from a main body of an electrophotographic apparatus, comprising an electrophotographic photosensitive member and the charging member according to claim 1.

4. An electrophotographic apparatus comprising the charging member according to claim 1 and an electrophotographic photosensitive member.

5. The charging member according to claim 1, wherein the porous body has a configuration in which some of a plurality of pores intersect to be communicated in a direction intersecting the thickness of the surface layer.

6. The charging member according to claim 1, wherein the surface layer has a configuration in which a plurality of pores is linked so that the outside of the surface layer, facing the electroconductive support, is communicated with the outside of the surface layer, facing the surface.

7. The charging member according to claim 1, wherein the porous body has a shape characteristic of spinodal decomposition.

8. The charging member according to claim 1, wherein the surface layer is formed of a fine fiber.

9. The charging member according to claim 8, wherein the fine fiber has an average fiber diameter of 0.01 to 40 μm.

10. The charging member according to claim 8, wherein the fine fiber has a diameter in a range of from 0.5 to 3.0 μm.

* * * * *